US011787591B2

(12) United States Patent
Schriner

(10) Patent No.: US 11,787,591 B2
(45) Date of Patent: Oct. 17, 2023

(54) COMPOSITION CONTAINER WITH FRONT SURFACE PRESERVING RECESS

(71) Applicant: Henkel AG & Co. KGaA, Duesseldorf (DE)

(72) Inventor: Gregory Schriner, Phoenix, AZ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 17/305,404

(22) Filed: Jul. 7, 2021

(65) Prior Publication Data

US 2021/0331825 A1 Oct. 28, 2021

Related U.S. Application Data

(63) Continuation of application No. 15/728,586, filed on Oct. 10, 2017, now abandoned.

(51) Int. Cl.

| | |
|---|---|
| ***B65D 1/32*** | (2006.01) |
| ***B65D 25/54*** | (2006.01) |
| ***B65D 1/02*** | (2006.01) |
| ***B65D 1/42*** | (2006.01) |

(52) U.S. Cl.

CPC ..... *B65D 1/32* (2013.01); *B65D 1/023* (2013.01); *B65D 1/42* (2013.01); *B65D 25/54* (2013.01)

(58) Field of Classification Search

CPC ..... B65D 1/0292; B65D 21/086; B65D 1/32; B65D 1/023; B65D 1/42; B65D 25/54; B65D 83/00; B65D 83/0005; A47K 5/1217

USPC ..... 222/92, 95, 321.7

See application file for complete search history.

(56) References Cited

U.S. PATENT DOCUMENTS

| | | | | |
|---|---|---|---|---|
| 9,138,109 | B1 * | 9/2015 | Leon | B05B 3/02 |
| 2009/0114679 | A1 * | 5/2009 | Ophardt | B65D 35/02 220/666 |
| 2012/0193320 | A1 * | 8/2012 | Stanca | B65D 1/0292 141/2 |

* cited by examiner

*Primary Examiner* — Vishal Pancholi
*Assistant Examiner* — Robert K Nichols, II
(74) *Attorney, Agent, or Firm* — James J. Cummings

(57) ABSTRACT

A composition container is described. The composition container includes an interior portion to contain a composition. A recess along a back surface of the composition container promotes the collapse of the composition container along the back surface. A number of reinforcing ribs on the front surface of the composition container promote the preservation of the front surface of the composition container during collapse of the composition container.

13 Claims, 8 Drawing Sheets

COMPOSITION CONTAINER WITH FRONT SURFACE PRESERVING RECESS

FIELD OF THE INVENTION

The present invention generally relates to a composition container, and more particularly relates to a composition container that includes features to preserve a front surface of the container during a collapse of the container.

BACKGROUND OF THE INVENTION

A composition container is used to hold a composition for use by a user. Various types of compositions can be disposed within a particular container. Examples of such compositions include personal care compositions such as soaps, lotions, disinfectants, hair sprays, deodorants and/or antiperspirant sprays, perfumes, colognes, and bug sprays. Other types of hair care products, skin care products or personal care products can also be disposed within a container. These are just a few examples, and any number of compositions, both personal care compositions and non-personal care compositions can be disposed within a composition container. The breadth of examples indicates the wide use of compositions, and containers for those compositions in modern society. Accordingly, a composition container that provides additional and unique benefit may be desirable for the additional consumer advantages it provides.

Some containers are disposed within a dispenser. As the contents of the container are disposed, forces, such as vacuum forces that result from composition being ejected, cause the container to collapse. Such deformation of the container may distort any label disposed on a front of the container such that it is not viewable through the dispenser in which the container is disposed.

Accordingly, it is desirable to have a composition container that accommodates different compositions disposed therein as well as providing additional consumer advantages. It is further desirable to provide a composition container that collapses in such a fashion as to preserve the front surface, where an identifying label is disposed, allowing continual identification of the manufacturer of the container and/or composition within the container. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A composition container is described. The composition container includes an interior portion to contain a composition. A recess along a back surface of the container composition promotes collapse of the composition container along the back surface. A number of reinforcing ribs on a front surface of the composition container promote preservation of the front surface during collapse of the composition container.

In one example, a composition container includes an interior portion to contain a composition. The composition container also includes a front surface and a back surface opposite the front surface. Multiple side surfaces join the front surface to the back surface. A recess along the back surface of the composition container promotes collapse of the composition container along the back surface and a number of reinforcing ribs on the front surface of the composition container promote the preservation of the front surface during collapse of the composition container. In this example, a number of protrusions on the multiple side surfaces extend away from the composition container and also promote collapse along the back surface and preserve the front surface during collapse of the composition container. Responsive to a vacuum force from the interior portion, the composition container collapses along the back surface while preserving the front surface.

The present application also describes a composition dispensing system. The composition dispensing system includes a composition container. The composition container includes an interior portion to contain a composition. The composition container also includes a recess along a back surface of the composition container to promote collapse of the composition container along the back surface and a number of reinforcing ribs on a front surface of the composition container to promote preservation of the front surface during collapse of the composition container. The composition dispensing system also includes a dispensing mechanism to dispense the composition from the composition container onto an application surface.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

As described above, a wide variety of compositions, such as personal care compositions and other compositions are used in society. In some cases, the composition containers are used in environments where it would be desirable to maintain the integrity of the front surface of the container.

For example, the container may be disposed within a dispenser. In this example, the dispenser includes a window through which a portion of the front surface of the container is visible. This front surface may have a logo, other image, and/or text that is viewable through the window. This logo, image, or other text may be relevant, or important to display throughout the life of the container. During use, the composition container collapses, and such collapse could result in the misalignment of the window on the dispenser and the logo, other image, and/or text on the composition container. The collapse could also deform the front surface such that the logo, other image, and/or text is not discernible.

To alleviate these and other concerns, a composition container of the present application includes features that facilitate collapse along the back of the composition container while preserving the front surface of the composition container. Specifically, a recess along the back surface serves as an origination point for any collapse. Moreover, ribs along the front surface of the composition container preserve the structural integrity of the front surface throughout the collapse process. Accordingly, when the composition container is emptied and the front surface would otherwise deform, these features allow the composition container to deform along the back surface, and side surfaces, as opposed to the front surface, thus maintaining the integrity and alignment of the front surface to enhance the visibility of the composition container through the window of any dispenser in which it is disposed.

Figure 1:
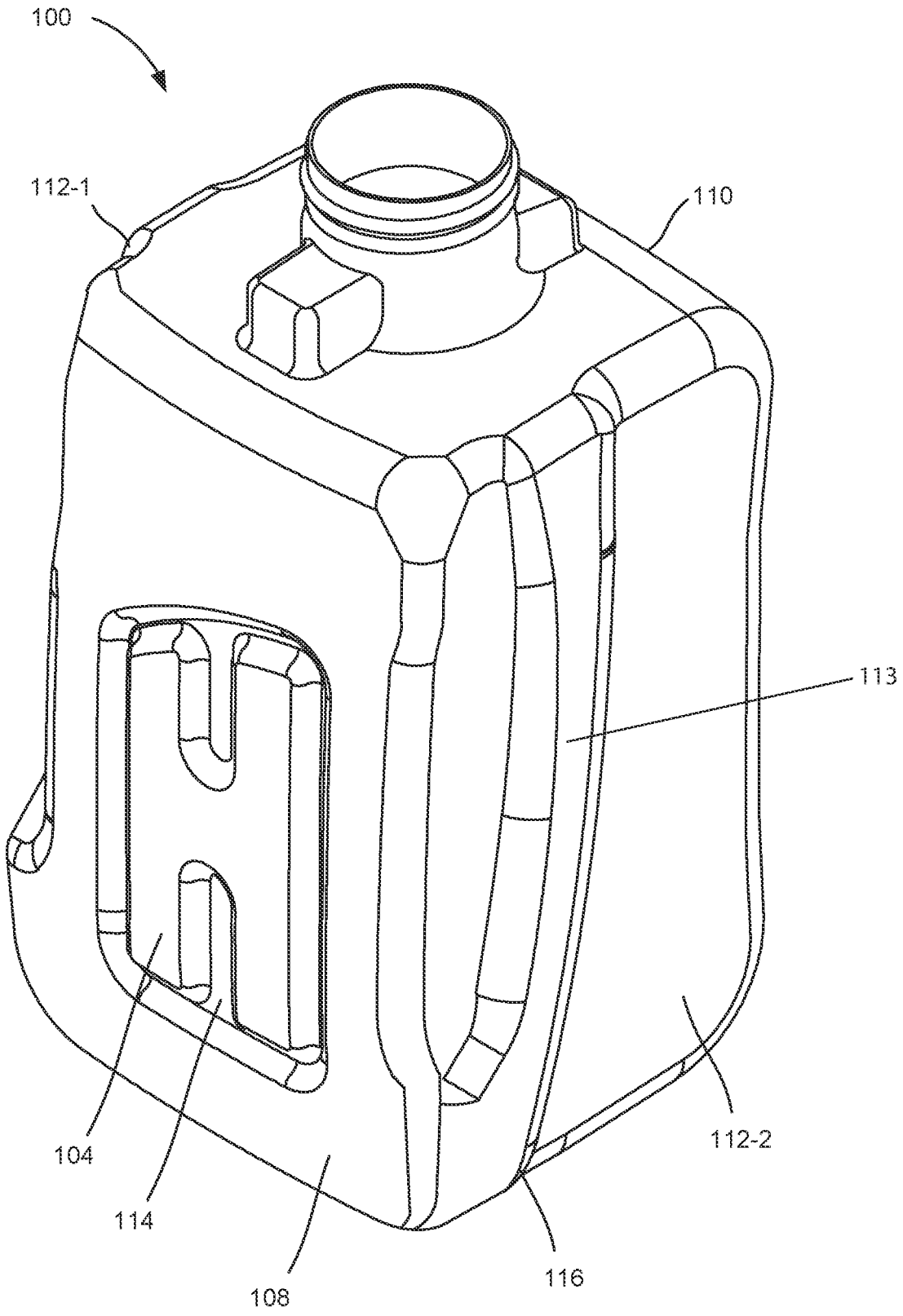
FIG. 1 is an isometric diagram of a composition container with a front surface preserving recess, according to an example of the principles described herein.

Turning now to the figures, FIG. 1 is an isometric diagram of a composition container (100) with a front surface preserving recess, according to an example of the principles described herein. The composition container (100) includes an interior portion to hold a volume of composition. The composition container (100) may be made of any material including plastic, aluminum, or a composite, among other types of composition container (100) material. In other words, the composition container (100) is made of any material that can retain a volume of the composition disposed therein. Moreover, the composition container (100) is made of any material that can deform as composition is expelled therefrom. Examples of compositions that may be disposed within the composition container (100) include lotions, soaps, disinfecting compositions, and antibacterial compositions, among others. The composition may take many forms. For example, the composition may be a fluid, a gel, an emulsion, a foam, or a foaming gel. While specific examples are provided of specific compositions disposed within the composition container (100), any number of compositions of any form that are to be applied to a surface may be disposed therein.

Figure 2:
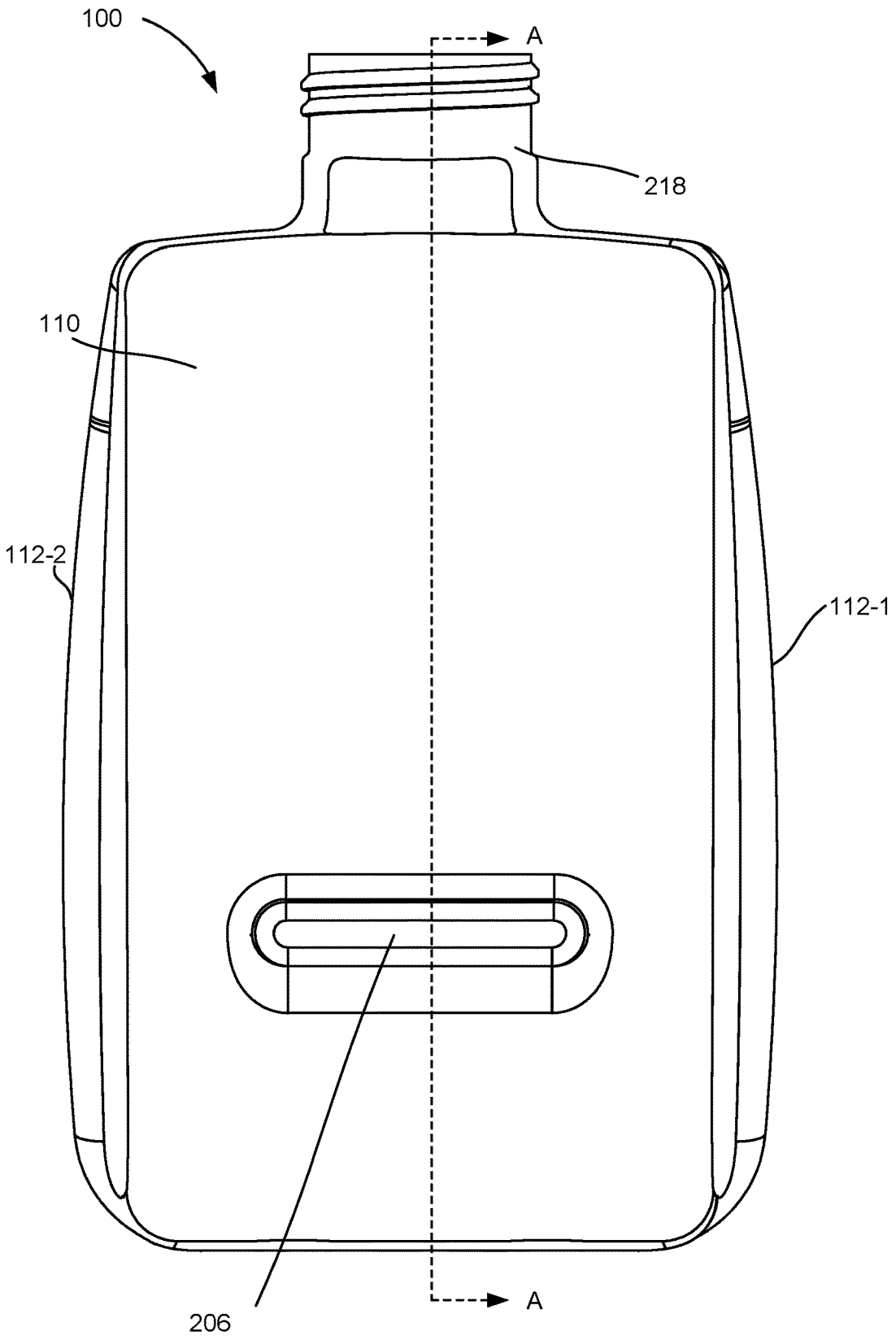
FIG. 2 is a rear diagram of the composition container with a front surface preserving recess, according to an example of the principles described herein.

The composition container (100) also includes a number of reinforcing ribs (104) disposed on a front surface (108) of the composition container (100). The reinforcing ribs (104) promote preservation of the front surface (108) during collapse of the composition container (100). As can be seen in FIG. 2, the composition container (100) also includes a recess (206) along a back surface (110) of the composition container (100) to promote collapse of the composition container (100) along the back surface (110). That is, the composition container (100) has a front surface (108), a back surface (110), and multiple side surfaces (112-1, 112-2) that join the front surface (108) to the back surface (110). It may be desirable to collapse the composition container (100) along the back surface (110) and side surfaces (112-1, 112-2) so that the front surface (108) is preserved such that any identifying logo or text can be readily viewable. In other words, responsive to a force, such as a vacuum force from inside the composition container (100), the composition container (100) collapses along the back surface (110) while preserving the front surface (108). This directed collapse is facilitated by the recess (206) and the reinforcing ribs (104).

Figure 4:
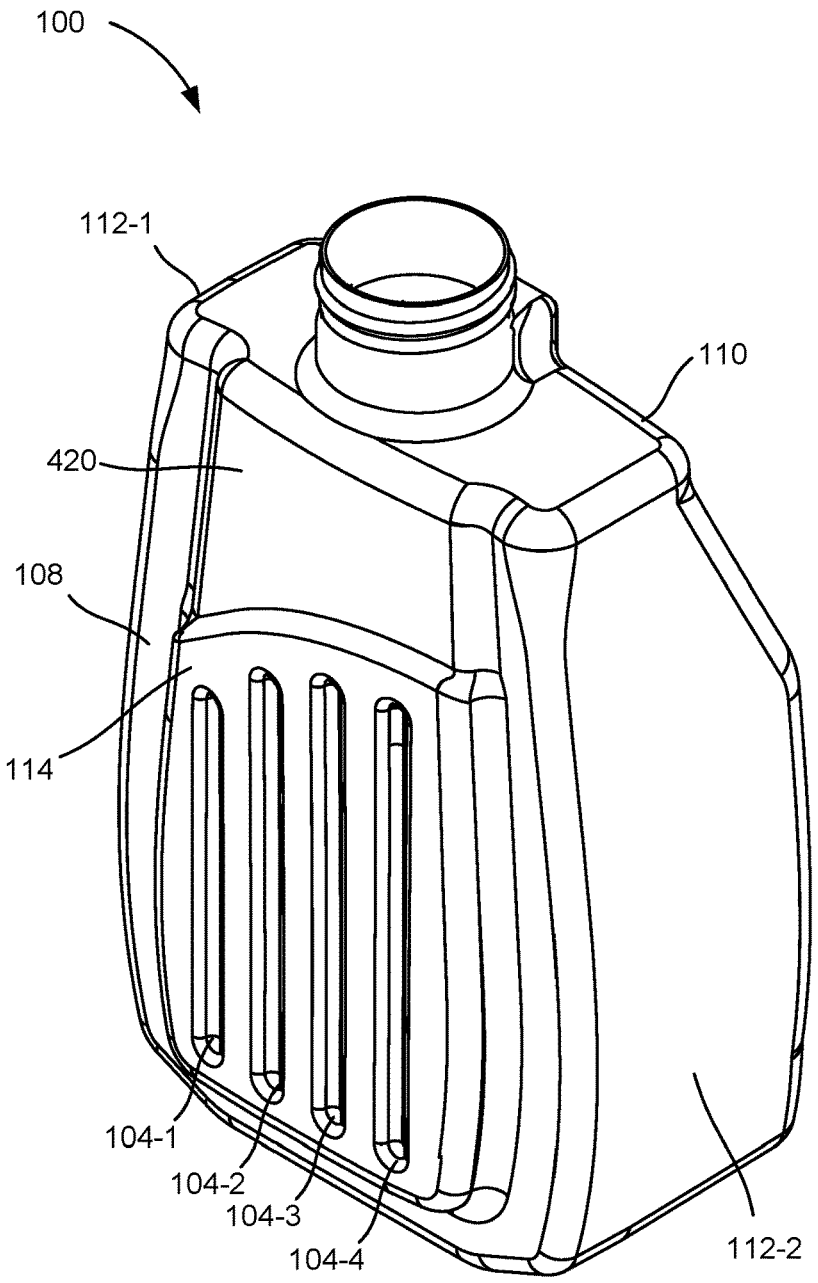
FIG. 4 is an isometric diagram of a composition container with a front surface preserving recess, according to another example of the principles described herein.

More specifically, as can be clearly seen in FIG. 2, the recess (206) along the back surface (110) protrudes inward towards a center of the composition container (100). Such a recess (206) acts as a weak point in the composition container (100) such that any deformation of the composition container (100) will initiate at the recess (206). By comparison, the reinforcing ribs (104) disposed on the front surface (108) increase the structural strength of the front surface such that the front surface (108) can withstand greater forces. In some examples, for example as depicted in FIG. 1, the reinforcing ribs (104) protrude outward from the composition container (100). However, in other examples, such as depicted in FIG. 4, the reinforcing ribs (104) may protrude inward towards a center of the composition container (100). These two elements combined, i.e., the recess (206) and the reinforcing ribs (104) create a disparity in the structural strength of the front surface (108) as compared to the back surface (110) such that upon collapse, the back surface (110) collapses before the front surface (108), which front surface (108) may not collapse at all.

Returning to the reinforcing ribs (104), as depicted in FIG. 1, the reinforcing ribs (104) may include vertically-disposed portions. For example, the reinforcing ribs (104) may include vertically-disposed portions joined by a horizontal portion. In another example as depicted in FIG. 4, the reinforcing ribs (104) may be entirely vertical. The vertical disposition of the reinforcing ribs (104), or portions of the reinforcing ribs (104) increases the structural strength of this front surface (108) more fully preserving its structure and alignment during collapse of the composition container (100).

In some examples, the reinforcing ribs (104) are disposed on a panel (114). In some examples, specifically as depicted in FIG. 1, the panel (114) may be a recessed panel. In other examples, for example as depicted in FIG. 4, the panel (114) may protrude outward. In the example depicted in FIG. 1, where the panel (114) is recessed, the number of reinforcing ribs (104) are disposed within the recessed panel (114) and protrude outward from the recessed panel (114).

In some examples, each side surface (112-1, 112-2) also includes a number of protrusions (113) that extend away from the composition container (100). Specifically, each side surface (112) may include a parting line (116) that is angled towards a lower front portion of each side surface (112). Such parting lines (116) further promote the preservation of the front surface (108) during collapse by absorbing the collapsing force. That is, as described above, the recess (FIG. 2, 206) along the back surface (110) provides a structural weak point so that any deformation occurs first along the back surface (110), the parting lines (116) along the side surfaces (112) ensure that any further collapse continues along the back surface (110) or the side surfaces (112) and not the front surface (108).

FIG. 2 is a rear diagram of the composition container (100) with a front surface (FIG. 1, 108) preserving recess, according to an example of the principles described herein. FIG. 2 clearly depicts the recess (206) that serves as the structural weak point for the composition container (100). As noted above, the recess (206) may protrude inward towards a center of the composition container (100). Moreover, as depicted in FIG. 2, the recess (206) may be horizontally oriented to promote collapse of the back surface (110).

In some examples, the recess (206) is disposed on a lower portion of the back surface (110). Note that in use, the composition container (100) may be inverted such that a dispensing port (218) of the composition container (100) is on the bottom of the composition container (100). In this fashion, the contents of the composition container (100) are gravity fed out of the dispensing port (218). However, for purposes of this disclosure, the orientation, and reference of the composition container (100), is in this upright position. The recess (206) may be located at this lower portion of the back surface (110) represents the structurally weakest location on the composition container (100).

Figure 3:
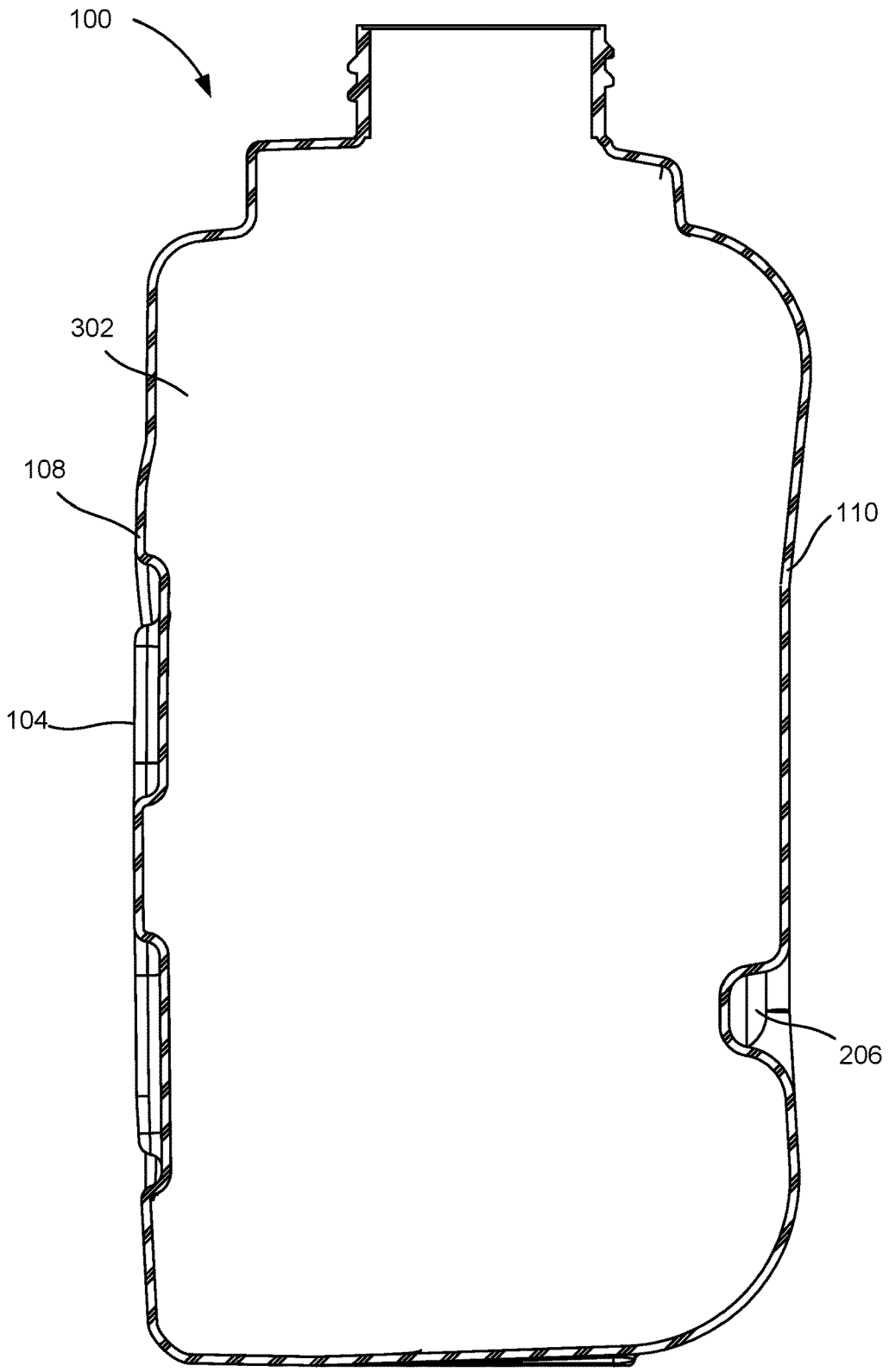
FIG. 3 is a cross-sectional diagram of the composition container with a front surface preserving recess, according to an example of the principles described herein.

FIG. 3 is a cross-sectional diagram of the composition container (100) with the front surface (108) preserving recess (206), according to an example of the principles described herein. Specifically, FIG. 3 is a cross-sectional diagram of the composition container (100) taken along the line "A-A" from FIG. 2. As can be seen in FIG. 3, the composition container (100) can hold a volume of the composition within the interior portion (302), whatever that composition may be. In one specific example, the composition is a hand soap or a sanitizer that is disposed within a composition container (100), which composition container (100) may be contained within a dispenser.

As is clearly visible from FIG. 3, the recess (206) projects inwards towards the center of the composition container (100) and the reinforcing ribs (104) extend away from the center of the composition container (100). In some examples, a thickness of at least a portion of the front surface (108) is greater than a material thickness for the back surface (110). The difference in thickness increases the strength disparity between the front surface (108) and the back surface (110). It is this disparity that ensures the composition container (100) collapses along the back surface (110) while preserving the front surface (108).

FIG. 4 is an isometric diagram of a composition container (100) with a front surface (108) preserving recess, according to another example of the principles described herein. As described above, the composition container (100) includes a number of reinforcing ribs (104-1, 104-2, 104-3, 104-4). In this example, the reinforcing ribs (104) may protrude inward, but may still be vertically-disposed to add structural strength to the front surface (108). In this example, the composition container (100) also includes the panel (114) on which the reinforcing ribs (104) are disposed. In this example, the panel (114) is not recessed, but protrudes outward. In some examples, as depicted in FIG. 4, the panel (114) may further be disposed on a central portion (420) of the front surface (108) which central portion (420) extends away from the front surface (108). Such a protruding central portion (420) further enhances structural stability. Specifically, the corners that form from the various protrusions and recesses create structural strong points on the front surface (108) such that the front surface (108) is less likely to collapse as compared to the back surface (110) which has fewer structural angles.

Figure 5:
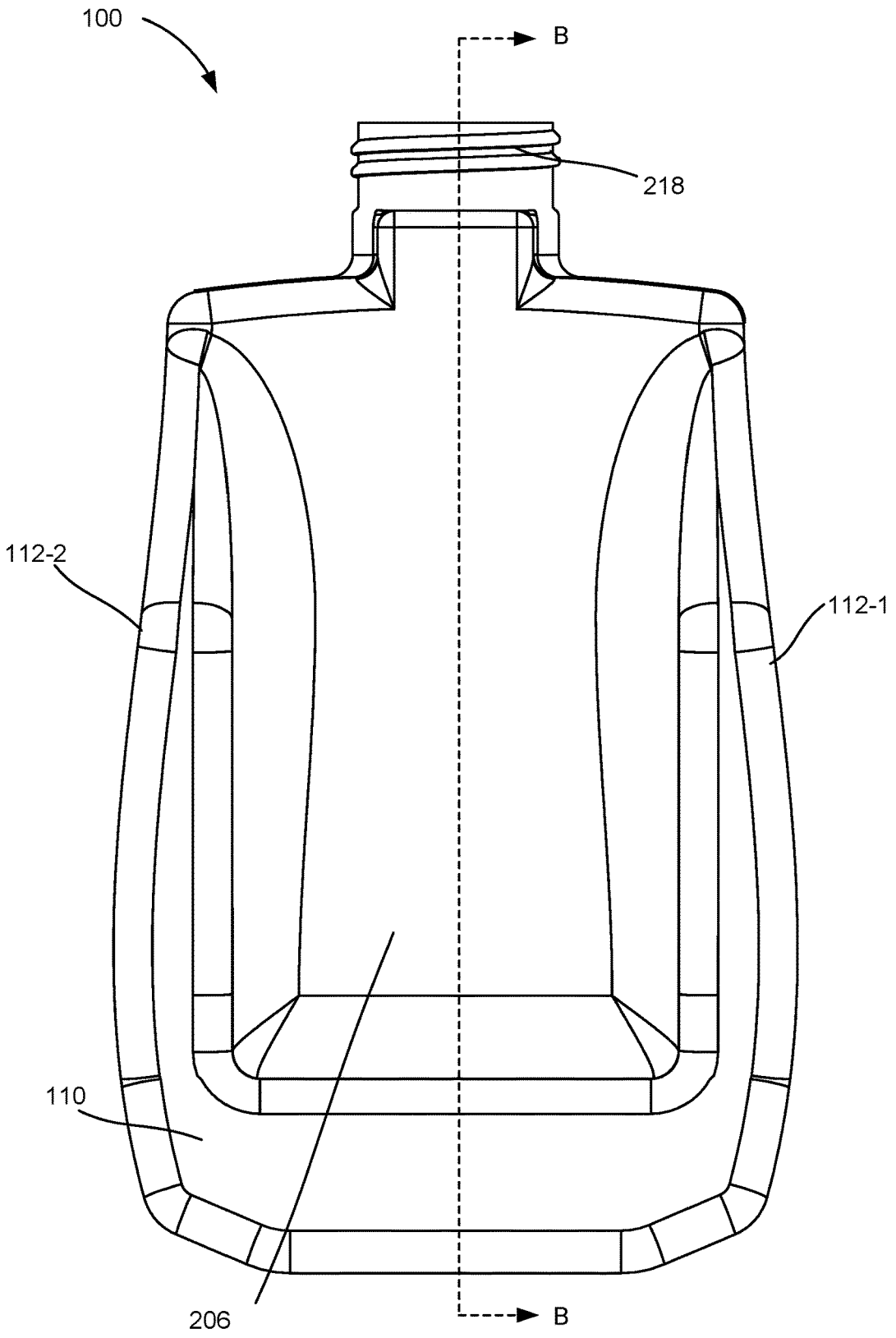
FIG. 5 is a rear diagram of the composition container with a front surface preserving recess, according to an example of the principles described herein.

FIG. 5 is a rear diagram of the composition container (100) with a front surface (FIG. 1, 108) preserving recess (206), according to an example of the principles described herein. FIG. 5 clearly depicts the recess (206) that serves as the structural weak point for the composition container (100). As noted above, the recess (206) may protrude inward towards a center of the composition container (100). As depicted in FIG. 5, the recess (206) may occupy a large portion of the back surface (110). For example, in some cases the composition container (100) may be part of a touch-free composition dispensing system. In such a system, a power supply provides the mechanism by which the composition is ejected. The recess (206) along the back may be the same size and shape as the power supply. Accordingly, the recess (206), along with providing a structural weak point for collapse of the composition container (100), also provides a receptacle for the power supply of a touch-free composition dispensing system.

Figure 6:
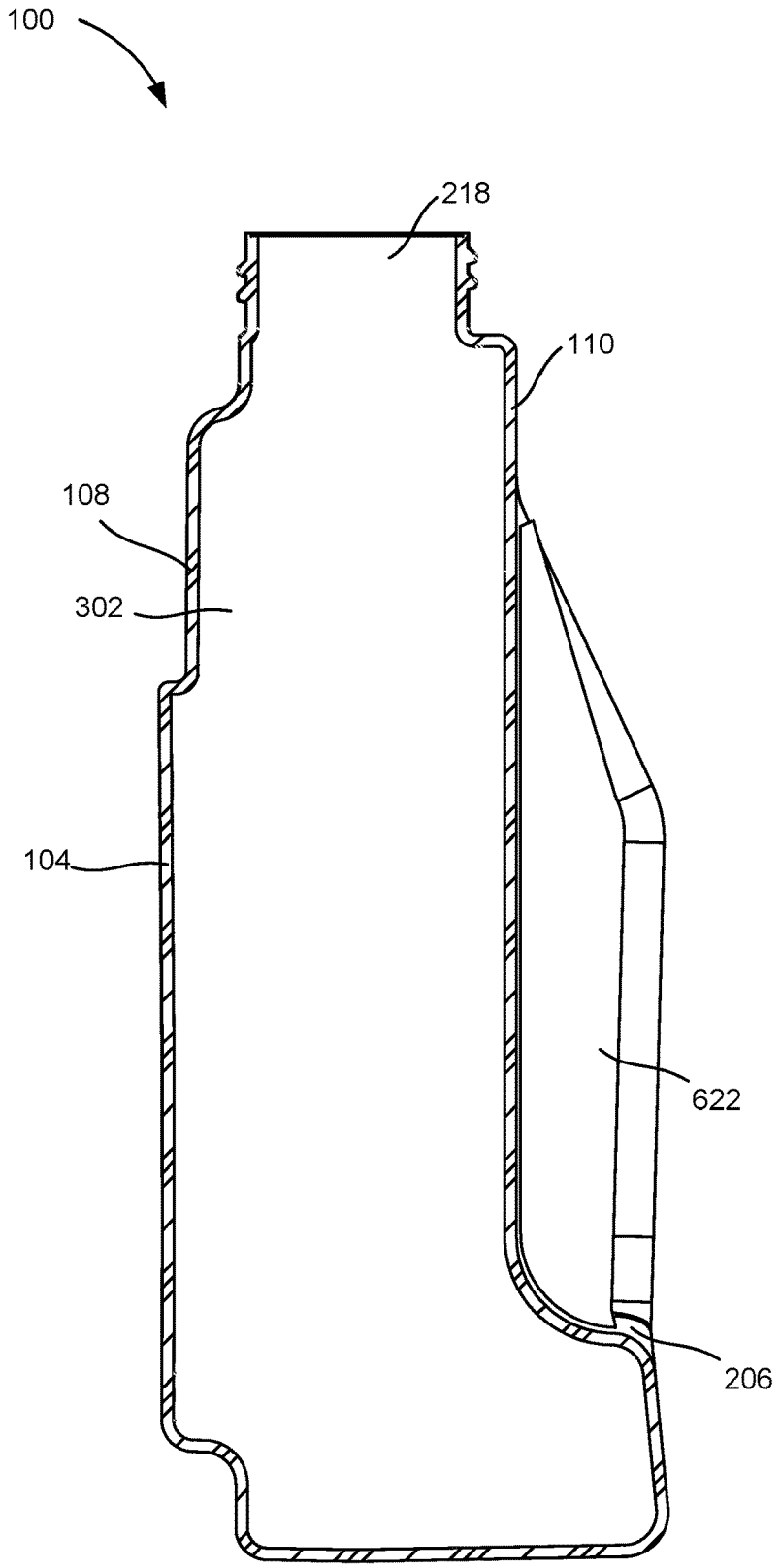
FIG. 6 is a cross-sectional diagram of the composition container with a front surface preserving recess, according to an example of the principles described herein.

FIG. 6 is a cross-sectional diagram of the composition container (100) with a front surface (108) preserving recess (206), according to an example of the principles described herein. Specifically, FIG. 6 is a cross-sectional diagram of the composition container (100) taken along the line "B-B" from FIG. 5. As can be seen in FIG. 6, the composition container (100) can hold a volume of the composition in the interior portion (302), whatever that composition may be. As is clearly visible from FIG. 6, the recess (206) projects inwards towards the center of the composition container (100).

FIG. 6 also depicts a power supply (622) disposed in the recess (206) of the composition container (100). That is, the composition container (100) may be part of a composition dispensing system. The composition dispensing system also includes a dispensing mechanism to dispense the composition from the composition container (100) onto an application surface. The dispensing mechanism may be simply the dispensing port (218) through which the composition is ejected. In this example, as will be described below, the composition is dispensed via manual user manipulation.

In other examples, the dispensing mechanism may be a touch-free dispensing mechanism that is activated independent of user touch. For example, as a user triggers a motion detector on the dispenser in which the container (100) is disposed, the dispensing mechanism may activate to automatically dispense composition without user touch. In this example, the dispensing mechanism includes circuitry to activate the touch-free dispensing mechanism and a power supply (622) to provide power to the touch-free dispensing mechanism. In this example, as depicted in FIG. 6, the recess (206) may be the same size and shape as the power supply (622) and the power supply (622) may be affixed to the outside of the composition container (100) in the recess (206).

In some examples, the recess (206) may be disposed on an upper portion of the back surface (110). Note that in use, the composition container (100) may be inverted such that the dispensing port (218) of the composition container (100) is on the bottom of the composition container (100). In this fashion, the contents of the composition container (100) are gravity fed out of the dispensing port (218). However, for purposes of this disclosure, the orientation, and reference of the composition container (100) is in this upright position.

Figure 7:
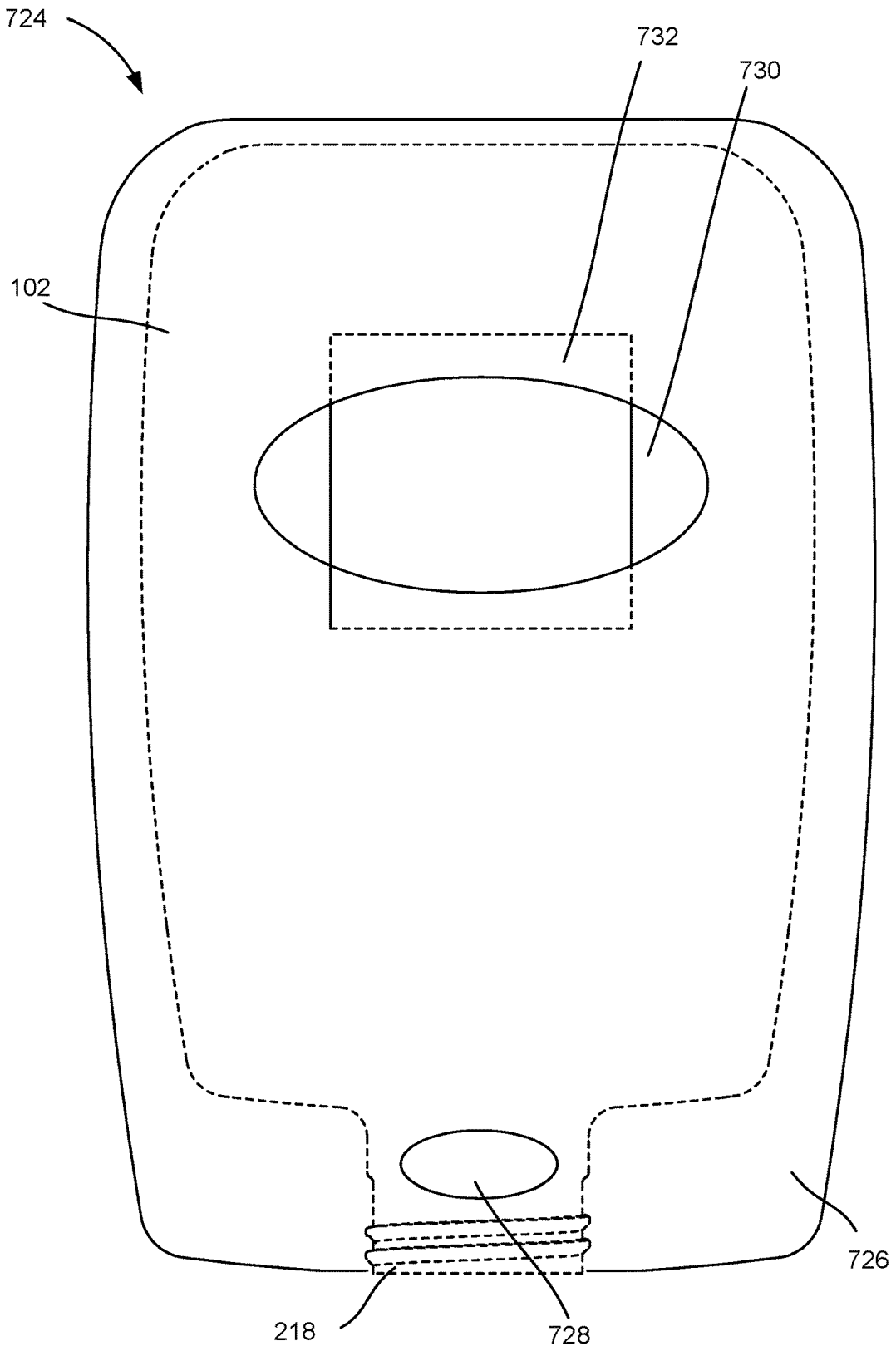
FIG. 7 is a front diagram of a composition dispensing system, according to an example of the principles described herein.

FIG. 7 is a front diagram of a composition dispensing system (724), according to an example of the principles described herein. The composition dispensing system (724) includes the composition container (100) as described above which contains the recess (FIG. 2, 206) along the back surface (FIG. 1, 110) and the number of reinforcing ribs (FIG. 1, 104) along the front surface (FIG. 1, 108). The composition dispensing system (724) also includes a dispenser housing (726) to retain the composition container (100) during use. The dispenser housing (726) has a port that aligns with the dispensing port (218) on the composition container (100) to define an outlet path from the composition container (100). In FIG. 7, the dashed lines indicate a component that is internal. For example, the composition container (100) is in dashed lines to indicate it is internal to the dispenser housing (726). In some examples, the dispenser housing (726) is mountable to a surface. For example, the composition container (100) may hold hand soap or sanitizer and the dispenser housing (726) in which the composition container resides may be mounted to a surface such as a restroom wall or a kitchen wall.

In some examples, the composition dispensing system (724) is a manual dispensing system wherein the dispensing mechanism is activated via user touch. For example, the dispenser housing (726) may include a button (728) or other activator, that when acted upon by force, works to dispel the composition from the composition container (100).

The dispenser housing (726) may include a window (730) therein, through which the front surface (FIG. 1, 108) of the composition container (100) is viewable. The composition container (100) may include a label (732) disposed on the front surface (FIG. 1, 108). As the front surface (FIG. 1, 108) is preserved during collapse, the label (732) is also preserved during the collapse along the back surface (FIG. 1, 110) of the composition container (FIG. 1, 100).

Figure 8C:
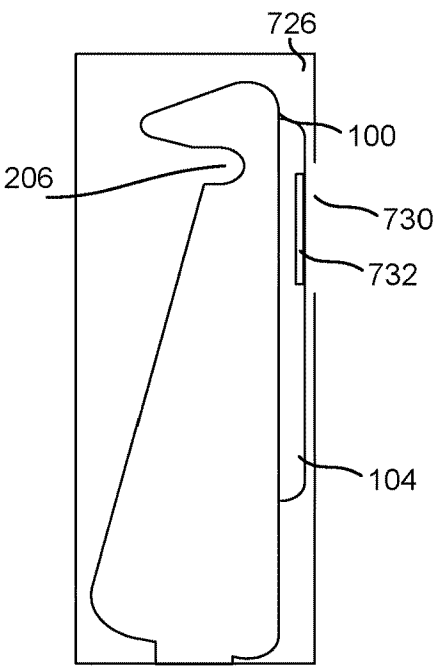
FIGS. 8A-8C are cross-sectional diagrams of a composition dispensing system at various stages of use, according to an example of the principles described herein.
Figure 8B:
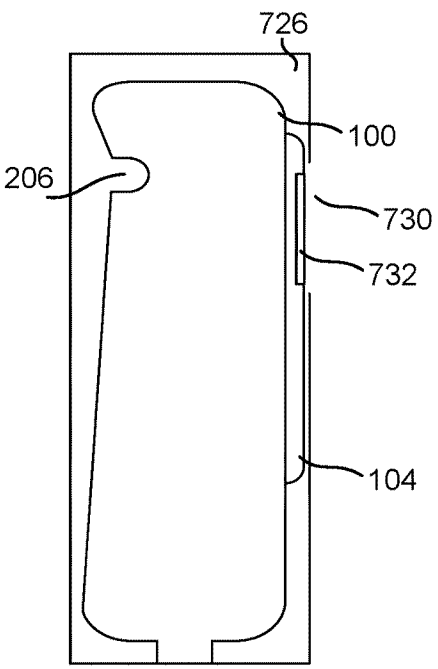
Figure 8A:
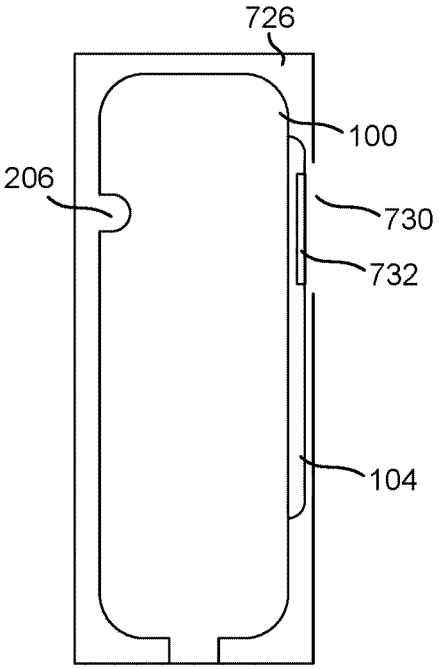

FIGS. 8A-8C are cross-sectional diagrams of the composition dispensing system (FIG. 7, 724) at various stages of use, according to an example of the principles described herein. Specifically, as depicted in FIG. 8A, the composition container (100) is disposed within the dispenser housing (726) such that a label (732) or other identifying information is viewable through a window (730) in the dispenser housing (726). Then, as depicted in FIG. 8B, as a force operates to eject the composition from the composition container (100), a vacuum force caused by the expulsion of the composition, causes the composition container (100) to begin to collapse. The recess (206) on the back surface (FIG. 1, 110) creates a weak point on the back surface (FIG. 1, 110), thus promoting collapse along the back surface (FIG. 1, 110).

Simultaneously, reinforcing ribs (104) on the front surface (FIG. 1, 108) strengthen the front surface (FIG. 1, 108), thus ensuring its preservation during this collapse period. Note that the reinforcing ribs (104) and the recess (206), in addition to preserving the front surface (FIG. 1, 108), also ensure the alignment of the front surface (FIG. 1, 108) of the composition container (100) and the window (730) of the dispenser housing (726) such that the label (732), or other identifying information will be visible, legible, or otherwise discernible throughout all stages of collapse.

As depicted in FIG. 8C, the continual exertion of force resulting from the expulsion of composition from the composition container (100) continues to deform the composition container (100). However, due to at least the recess (206) and the reinforcing ribs (104), any collapse is along the side surface (FIG. 1, 112) and/or back surface (FIG. 1, 110) and the front surface (FIG. 1, 108) and its corresponding label (732) are preserved and viewable.

In summary, the present specification describes a composition container (100) with a recess (206) along the back surface (FIG. 1, 110) and reinforcing ribs (104) along the front surface (FIG. 1, 108). These features ensures that any collapse of the composition container (100) resulting from use, is along the back surface (FIG. 1, 110) such that the structural integrity and therefore the view of the front surface (FIG. 1, 108) is preserved. Such a composition container (100) thereby allows for the continual display of information through a window (730) in a dispenser housing (726) in which the composition container (100) is disposed.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A composition dispensing system comprising:
a composition container comprising:
an interior portion to contain a composition;
a front surface;
a back surface opposite the front surface; and
multiple side surfaces to join the front surface to the back surface;
a recess along the back surface of the composition container to promote collapse of the composition container along the back surface; and
a number of reinforcing ribs on the front surface of the composition container to promote preservation of the front surface during collapse of the composition container;
a number of protrusions on the multiple side surfaces that extend away from the composition container to promote collapse along the back surface and to preserve the front surface during collapse of the composition container; and
a dispensing mechanism to dispense the composition from the composition container onto an application surface,
the dispensing mechanism is a touch-free dispensing mechanism that is activated independent of user touch;
the composition dispensing system further comprises:
circuitry to activate the touch-free dispensing mechanism,
a power supply to provide power to the touch-free dispensing mechanism, and
the power supply is affixed to the outside of the composition container in the recess.

2. The system of claim 1, wherein the recess along the back surface of the composition container is disposed on a top half of the back surface.

3. The system of claim 1, further comprising a label disposed on the front surface of the composition container, which label is preserved as the composition container collapses along the back surface while preserving the front surface of the composition container.

4. The system of claim 1, further comprising a dispenser housing having a window therein through which the front surface of the composition container is viewable.

5. The system of claim 4, wherein the recess and the number of reinforcing ribs ensure the alignment of the front surface of the composition container and the window of the dispenser.

6. A composition dispensing system comprising:
a composition container comprising:
an interior portion to contain a composition;
a front surface;
a back surface opposite the front surface; and
multiple side surfaces to join the front surface to the back surface;
a recess along a back surface of the composition container to promote collapse of the composition container along the back surface; and a number of reinforcing ribs on the front surface of the composition container to promote preservation of the front surface during collapse of the composition container;

a number of protrusions on the multiple side surfaces that extend away from the composition container to promote collapse along the back surface and to preserve the front surface during collapse of the composition container;

a dispenser housing to retain the composition container during use, and a dispensing mechanism to dispense the composition from the composition container onto an application surface, the dispensing mechanism is a touch-free dispensing mechanism that is activated independent of user touch;

the composition dispensing system further comprises:

circuitry to activate the touch-free dispensing mechanism, a power supply to provide power to the touch-free dispensing mechanism, and the power supply is affixed to the outside of the composition container in the recess.

7. The system of claim 6, further comprising a label disposed on the front surface of the composition container, which label is preserved as the composition container collapses along the back surface while preserving the front surface of the composition container.

8. The system of claim 6, wherein the dispenser housing has a window therein through which the front surface of the composition container is viewable.

9. The system of claim 6, wherein the dispensing mechanism comprises a dispensing port, wherein the contents of the composition container are gravity fed out of the dispensing port.

10. A composition dispensing system comprising:

a composition container comprising:

an interior portion to contain a composition;

a front surface;

a back surface opposite the front surface; and multiple side surfaces to join the front surface to the back surface;

a recess along the back surface of the composition container to promote collapse of the composition container along the back surface; and a number of reinforcing ribs on the front surface of the composition container to promote preservation of the front surface during collapse of the composition container;

a number of protrusions on the multiple side surfaces that extend away from the composition container to promote collapse along the back surface and to preserve the front surface during collapse of the composition container; and a dispensing mechanism to dispense the composition from the composition container onto an application surface, the dispensing mechanism is a touch-free dispensing mechanism that is activated independent of user touch; and the composition dispensing system further comprises:

circuitry to activate the touch-free dispensing mechanism, a power supply to provide power to the touch-free dispensing mechanism, and the recess is the same size and shape as the power supply.

11. The system of claim 10, further comprising a label disposed on the front surface of the composition container, which label is preserved as the composition container collapses along the back surface while preserving the front surface of the composition container.

12. The system of claim 10, wherein the dispenser housing has a window therein through which the front surface of the composition container is viewable.

13. The system of claim 10, wherein the dispensing mechanism comprises a dispensing port, wherein the contents of the composition container are gravity fed out of the dispensing port.

* * * * *